United States Patent [19]

Gregg

[11] Patent Number: 4,937,885

[45] Date of Patent: Jul. 3, 1990

[54] HEAD COVERING

[76] Inventor: Robert F. Gregg, 1161 White Ave., Grand Junction, Colo. 81501

[21] Appl. No.: 290,422

[22] Filed: Dec. 27, 1988

[51] Int. Cl.[5] ..... A42B 1/04

[52] U.S. Cl. ..... 2/196; 2/171; 2/209.1

[58] Field of Search ..... 2/171, 171.5, 171.6, 2/181, 196, 202, 205, DIG. 11; 24/266; 36/50

[56] References Cited

U.S. PATENT DOCUMENTS

| | | | |
|---|---|---|---|
| 768,626 | 8/1904 | Rautenberg | 2/205 |
| 1,172,927 | 2/1916 | Bloch | 2/196 |
| 2,336,950 | 12/1943 | Moss | 24/266 |
| 3,072,916 | 1/1963 | Henderson | 2/209.1 |
| 3,237,210 | 3/1966 | Graber | 2/209.1 |
| 3,285,307 | 11/1966 | Dormaier | 2/196 |
| 3,449,766 | 6/1969 | Garber | 2/196 |
| 4,165,542 | 8/1979 | McLaughlin | 2/209.1 |
| 4,384,371 | 5/1983 | Sonne | 2/196 |
| 4,506,417 | 3/1985 | Hara | 24/266 |
| 4,520,510 | 6/1985 | Daigle | 2/209.1 |
| 4,641,380 | 2/1987 | Epstein | 2/209.1 |
| 4,776,042 | 10/1988 | Hanson | 2/171 |

FOREIGN PATENT DOCUMENTS

| | | | |
|---|---|---|---|
| 1507338 | 12/1967 | France | 2/196 |
| 2171 | 2/1886 | United Kingdom | 2/202 |

*Primary Examiner*—Werner H. Schroeder
*Assistant Examiner*—Diana L. Biefeld
*Attorney, Agent, or Firm*—M. Reid Russell

[57] ABSTRACT

A head covering for configuration as a hat or headband that consists of a right circular cylindrical fabric body (11) with a sleeve (12) formed around the cylinder top end wherein is threaded a drawstring (13). The drawstring is to collapse the sleeve upon itself, closing the cylinder top end, which drawstring may include an arrangement for maintaining the drawstring in a tension state, the cylindrical body further including fasteners for maintaining the cylinder in a folded state as a headband.

5 Claims, 2 Drawing Sheets

HEAD COVERING

BACKGROUND OF THE INVENTION

1. Field of the Invention

This invention relates to cold weather wearing apparel and particularly to head coverings.

2. Prior Art

Caps and head or ear bands for wear by an individual as a protection against the cold are Well known. Such earlier head coverings have been manufactured from a variety of materials including knits and woven cloth, have often been lined and come in a variety of shapes and sizes. Knit hats that can be rolled at their open end to present a varying height dimension and knit ear bands, for encircling a wearer's ears, have long been known. However, within the knowledge of the inventor, prior to the present invention, a head covering arrangement that is adaptable to function as either a hat or headband has not been available.

SUMMARY OF THE INVENTION

It is a principal object of the present invention to provide a head cover that can be selectively configured as a hat for covering a wearer's head, or a headband, for encircling the wearer's head, covering their ears.

Another object of the present invention is to provide, utilizing a section of flexible fabric formed into a cylinder with a drawstring threaded around one end, for forming a hat that is closed across a top end or a head covering that can be selectively configured to function as a headband, which headband configuration alloWs the drawstring to be draWn tightly around a wearer's head, below their ears, forming a weather seal.

Another object of the present invention is to provide a head cover that can be selectively configured from a cylinder into a headband by merely folding the fabric cylinder into itself and includes fasteners for maintaining the folded sections in contacting arrangement.

Still another object of the present invention is to provide a head covering that is simple and inexpensive to construct from a knit or woven material, or like fabric material that can be easily and quickly configured as a hat or headband.

The present invention is in a head covering for cold weather wear as a hat or headband. The head covering consists of a cylinder constructed of a fabric heat retentive material suitable for wear on a person's head, such as a knit or weave, and includes a drawstring that is threaded through a sleeve formed around one end of the cylinder. The drawstring can be pulled to fold the sleeve upon itself, shortening the circumference to close off the cylinder end, which drawstring may include a shear clamp, friction casing, toggle nut, or the like, wherethrough the drawstrings are drawn for releasably prohibiting a back passage of the drawstrings therethrough.

Fasteners may be provided on the cylinder surface for connecting together when the cylinder ends are folded into the cylinder to form the headband, in which folding the sleeve end of the cylinder is preferably positioned below the wearer's ears allowing the drawstring to be drawn tightly and providing a weather seal.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
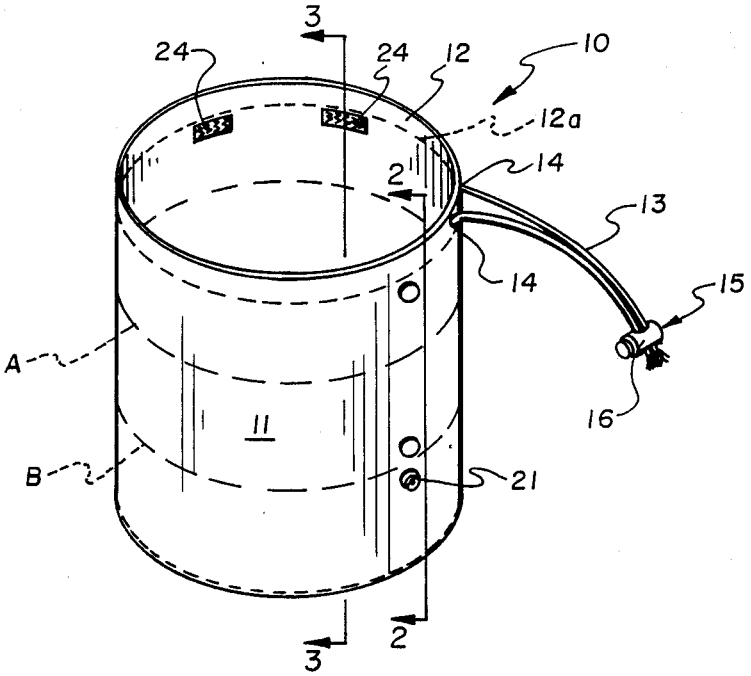
FIG. 1 is a side elevation perspective view of a fabric cylinder that is the invention in a head covering whereon broken lines are shown representing fold lines.
Figure 4:
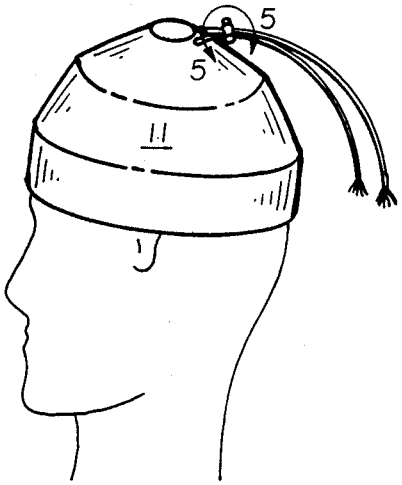
FIG. 4 is a profile perspective of a person's head with the head covering arrangement as a hat thereon, the drawstring shown drawn through a shear clamp to close the cylinder sleeve end.
Figure 6:
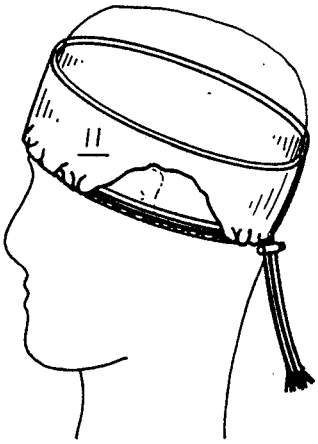
FIG. 6 is a profile perspective view of a person's head showing the head cover arranged as a headband fitted therearound, with a section removed therefrom showing the drawstrings as having been tightened to pull the sleeve tightly against the wearer's head.

FIG. 1 shows a preferred embodiment of a head covering 10 of the present invention that, as shown in FIG. 4, can be worn as a hat, or as shown in FIG. 6, can be folded and worn as a headband. Shown in FIG. 1, the head covering 10 is formed as a hollow right circular cylinder body 11, hereinafter referred to as cylinder from a knit material, or the like, so as to have good heat retentive properties. Around the cylinder 11 upper edge it is formed into a sleeve 12, preferably as by folding the cylinder end upon itself and sewing it at a broken line 12*a*. Through sleeve 12 a drawstring 13 is threaded, exiting through side by side openings 14 formed in the sleeve. The drawstring 13, is, in turn, preferably threaded through a shear clamp 15, or like clamp, casing, or toggle nut, that will allow the drawstrings 13 to be drawn therethrough and will bind against the drawstring, prohibiting its removal. So arranged, as shown in FIG. 4, the drawstring 13 can be drawn through shear clamp 15 to fold the sleeve 12 on itself closing the cylinder top end to form a hat configuration. Whereas, with the cylinder 11 folded upon itself, as shown in FIG. 6, it can be formed into a headband, the sleeve drawn upon itself to provide a weather seal.

Figure 5:
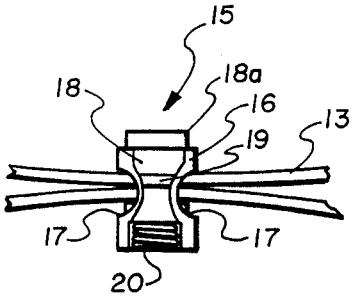
FIG. 5 is an exploded view taken within the line 5—5 of FIG. 4, showing the shear clamp with a longitudinal section removed therefrom exposing an inner cylinder with a lateral hole therethrough, and spring to urge the inner cylinder against drawstrings fitted therethrough.

Shown in FIG. 5, the shear clamp 15 wherethrough the ends of drawstring 13 are threaded consists of a cylindrical body 16 with a lateral hole 17 formed therethrough. The cylindrical body 16 is to accommodate a sleeve 18 fitted therein that has a lateral hole 19 formed therethrough. The lateral holes 17 and 19 are to align to accommodate the drawstring 13 fitted therethrough. Additionally, the sleeve 18 is biased by a coil spring 20 such that an upper end 18*a* thereof will extend beyond the cylinder 16 to be manually depressed. When depressed, the sleeve 18 is moved against the spring biasing aligning the lateral holes 17 and 19. So arranged, the biasing of coil spring 20 urges the sleeve 18 upwardly subjecting the drawstring to a shearing action as the lateral holes 17 and 19 move out of alignment, binding the shear clamp 15 to the drawstring. Which binding action is released by manually depressing the sleeve end 18*a*.

As set out above, the invention provides, with sheer clamp 15, for releasably maintaining the drawstring 13 pulled through sleeve 12 to close the cylinder 11 top end into the hat configuration of FIG. 4 or, with the cylinder 11 folded appropriately, it can be arranged as a headband fitted around the wearer's head, as shown in FIG. 6. It should, of course, be understood that any arrangement for releasably maintaining the drawstring 13 in a drawn attitude through sleeve 12 can be incorporated within the scope of this disclosure, to include tieing the drawstring ends into a bow.

As set out above, FIG. 6 shows the head covering 10 as having been formed into a headband. That forming involves folding the cylinder 11 upon itself, as discussed hereinbelow with respect to FIGS. 2A, 2B, 3A and 3B. In which folding schemes the sleeve 12 will come to rest alongside a wearer's face, below their ears. So arranged, the toggle nut 15 can be used to draw the sleeve 12 into close fitting engagement against the wearer's face, further keeping that person's ears warm.

In FIG. 1 the cylinder 11 is shown with equidistant circumferential upper and lower broken lines A and B, respectively. These broken lines are, of course, not actually included in practice around cylinder 11 and, it should be understood, are included herein for illustrating a preferred folding procedure of the present invention.

Figure 2A:
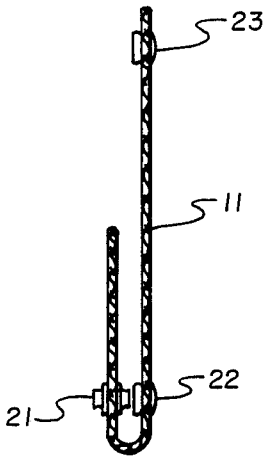
FIG. 2A is a sectional view taken along the line 2—2 of FIG. 1 showing the lower cylinder portion folded from the bottom upwardly along the lower broken line onto the cylinder mid-section, with snap halves shown aligned for coupling.
Figure 2B:
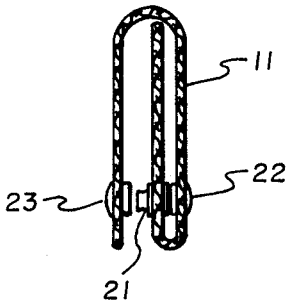
FIG. 2B shows the sectional view of FIG. 2A with the cylinder upper portion folded into the cylinder along the upper broken line such that a drawstring end thereof is positioned at the bottom end, with male and female snap halves shown aligned for coupling.

In forming the head covering 10 into a headband, FIG. 2A shows a lower section of cylinder 11, beloW broken line B, folded inwardly onto the cylinder 11 mid-section or portion that is between broken lines A and B. For maintaining the sections of body 11 in this folded engagement a least one and preferably two or three sets of snaps can be utilized, as shown in FIGS. 1, 2A and 2B. Shown therein, the cylinder 11 mid-section, proximate to the lower broken line B, includes a double male snap 21, that incorporates oppositely extending protuberances that project from a center disk portion. The snap protuberances are to individually couple, respectively, into a female snap portion 22 that is secured in the cylinder lower section, proximate to broken line B, as illustrated in FIG. 2A: and into a female snap portion 23 that is secured in the cylinder upper section, adjacent to sleeve 12, as illustrated in FIG. 2B.

FIG. 2A shows the body 11 lower section folded into the cylinder 11 With, in FIG. 2B, the body upper section, above broken line A, shown folded within the cylinder 11, against the lower section, forming the headband shown in FIG. 6. So arranged, the sleeve 12 containing drawstring 13 will be positioned alongside the wearer's head, below their ears. Which sleeve can be cinched tightly thereagainst by application of a tension force on the drawstring. A tight seal of the sleeve end of cylindrical body 11 is thereby formed to the wearer's head, with the headband extending across the wearer's ears.

Figure 3A:
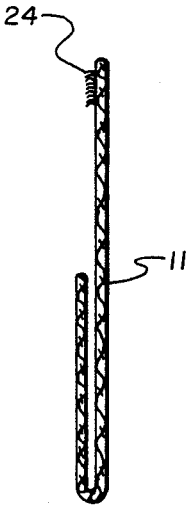
FIG. 3A is a sectional view taken along the line 3—3 of FIG. 1 showing the lower cylinder portion folded from the bottom upwardly along the lower broken line onto the cylinder mid-section.
Figure 3B:
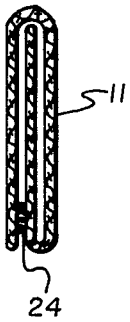
FIG. 3B shows the sectional view of FIG. 3A with the cylinder upper portion shown folded along the upper broken line onto the cylinder lower portion, a hook half of a section of a Velcro type fastener shown engaging the fabric of the cylinder lower portion.

The snaps shown in FIGS. 1, 2A and 2B are one arrangement for maintaining the cylinder 11 folded in thirds as the headband. Another arrangement for maintaining this folded attitude is shown in FIGS. 1, 3A and 3B, that consists of at least one but preferably two or three Velcro type hook surfaces 24, that are secured to be spaced apart equidistantly around the inside of cylinder 11, proximate to sleeve 12, and are for locking into the kit or fabric wherefrom the cylinder is formed. To form the headband, FIG. 3A shows the cylinder lower section below broken line B, folded into to align with the mid-section between broken lines A and B, and in FIG. 3B the cylinder upper section above broken line A is shown folded into to align with and rest against the lower section. So arranged, hooks of a Velcro matt 24 will enter into and lock to the weave or knit of the cylinder, maintaining the folded relationship of FIG. 6. Of course, it should be understood that the described arrangements of snaps and hook surfaces, as shown in FIGS. 1, 2A, 2B, 3A and 3B, are to be taken as optional inclusions and could be dispensed with, or other fastener arrangements could be so employed, within the scope of this disclosure.

While a preferred embodiment of the invention in a head covering and its use have been shown and described herein, it should be apparent that the present disclosure is made by way of example only and that variations thereto are possible within the scope of the disclosure without departing from the subject matter coming within the scope of the following claims, which claims I regard as my invention.

I claim:

1. A head covering comprising, a right circular cylindrical body formed of a flexible heat retentive material that includes a sleeve formed around a top edge thereof and formed for folding upon itself in equal thirds; a drawstring for threading through an opening in said sleeve, the drawstring ends to extend beyond said sleeve opening; means for maintaining the drawstring in a taut state against said sleeve opening; and coupling means for maintaining said right circular cylindrical body folded upon itself in thirds.

2. A head covering as recited in claim 1, wherein the right circular cylindrical body is formed of a knit or woven fabric material.

3. A head covering as recited in claim 1, wherein the means for maintaining the drawstring in a taut state is a shear clamp means consisting of, an outer cylinder with a sleeve telescoped therein, with lateral holes formed therethrough and spring biasing means to urge said inner sleeve lateral hole out of alignment with said cylinder lateral hole.

4. A head covering as recited in claim 1, wherein the means for maintaining the right circular cylindrical body folded upon itself in thirds is a system of snaps including at least one male snap half having oppositely extending protuberances that is arranged in a lower section or third of the right circular cylindrical body; and female snap halves, each for receiving and coupling to one of the protuberances of said male snap half, which female snap halves are individually secured to said upper and said mid-section or third of said cylindrical body, respectively, each to couple to one of said male snap half protuberances.

5. A head covering as recited in claim 1, wherein the means for maintaining the right circular cylindrical body folded upon itself in thirds is at least one section of a hook portion of a fastener means that is secured to an upper section or third of the cylindrical body for engaging and coupling into a surface of said cylindrical body.

* * * * *